US012408733B1

(12) United States Patent
Gadamsetti et al.

(10) Patent No.: US 12,408,733 B1
(45) Date of Patent: Sep. 9, 2025

(54) COMPOSITE TEXTILE

(71) Applicant: BRCE ATHLETIC CORP., East Lansing, MI (US)

(72) Inventors: Tanvi Lakshmi Gadamsetti, East Lansing, MI (US); Madhav Aggarwal, East Lansing, MI (US)

(73) Assignee: BRCE ATHLETIC CORP., East Lansing, MI (US)

( * ) Notice: Subject to any disclaimer, the term of this patent is extended or adjusted under 35 U.S.C. 154(b) by 0 days.

(21) Appl. No.: 19/069,710

(22) Filed: Mar. 4, 2025

Related U.S. Application Data

(60) Provisional application No. 63/563,358, filed on Mar. 9, 2024.

(51) Int. Cl.

| | |
|---|---|
| ***A43C 9/00*** | (2006.01) |
| ***D03D 11/00*** | (2006.01) |
| ***D03D 15/283*** | (2021.01) |
| ***D03D 15/44*** | (2021.01) |
| ***D04B 1/16*** | (2006.01) |
| ***D04B 1/24*** | (2006.01) |
| ***D04B 21/20*** | (2006.01) |

(Continued)

(52) U.S. Cl.
CPC ..... *A43C 9/00* (2013.01); *D03D 11/00* (2013.01); *D03D 15/283* (2021.01); *D03D 15/44* (2021.01); *D04B 1/16* (2013.01); *D04B 1/24* (2013.01); *D04B 21/207* (2013.01); *D04C 1/02* (2013.01); *D04C 1/06* (2013.01); *D04C 1/12* (2013.01); *D10B 2331/021* (2013.01); *D10B 2331/04* (2013.01); *D10B 2401/04* (2013.01); *D10B 2401/063* (2013.01); *D10B 2403/0114* (2013.01); *D10B 2501/063* (2013.01)

(58) Field of Classification Search
CPC ..... A43C 9/00; D03D 11/00; D03D 15/283; D03D 15/44; D04B 1/16; D04B 1/24; D04B 21/207; D04C 1/02; D04C 1/06; D04C 1/12; D10B 2331/021; D10B 2331/04; D10B 2401/04; D10B 2401/063; D10B 2403/0114; D10B 2501/063
See application file for complete search history.

(56) References Cited

U.S. PATENT DOCUMENTS 5,127,783 A * 7/1992 Moghe ..... F16B 33/006 411/908
11,872,419 B1 * 1/2024 Morgis ..... D03D 1/0005
(Continued)

*Primary Examiner* — David M Upchurch
(74) *Attorney, Agent, or Firm* — Quinn IP Law

(57) ABSTRACT

A composite textile includes a first layer formed from a two-yarn composite that includes a first yarn formed from meta-aramid fibers and a second yarn formed from polyester fibers. The composite textile includes a second layer formed from the two-yarn composite and abutting the first layer along a longitudinal axis. The first yarn has a first surface, the second yarn has a second surface, and the first yarn includes hooks each extending from the first surface toward the second surface. The first layer includes a first plurality of micro-ridges disposed along the first surface and the second layer includes a second plurality of micro-ridges disposed along the second surface. The first and second plurality of micro-ridges interact to generate friction between the first and second layers and limit movement of the first and second layers with respect to one another as the textile extends along the longitudinal axis.

20 Claims, 4 Drawing Sheets

(51) Int. Cl.

| | |
|---|---|
| ***D04C 1/02*** | (2006.01) |
| ***D04C 1/06*** | (2006.01) |
| ***D04C 1/12*** | (2006.01) |

(56) References Cited

U.S. PATENT DOCUMENTS

| | | | | |
|---|---|---|---|---|
| 12,284,955 | B2 * | 4/2025 | Clough | D02G 3/44 |
| 2005/0069703 | A1 * | 3/2005 | He | F16H 55/303 428/395 |
| 2005/0226584 | A1 * | 10/2005 | Williams | D04C 1/02 385/130 |
| 2013/0260629 | A1 * | 10/2013 | Dua | B29C 66/81435 428/221 |
| 2017/0029989 | A1 * | 2/2017 | Tuscia | B32B 27/322 |
| 2020/0199790 | A1 * | 6/2020 | Hayashi | D02G 3/04 |
| 2021/0172101 | A1 * | 6/2021 | Jayasundara | H05B 3/345 |

* cited by examiner

COMPOSITE TEXTILE

CROSS-REFERENCE TO RELATED APPLICATIONS

This application claims the benefit of priority to U.S. Provisional Patent Application No. 63/563,358, filed on Mar. 9, 2024, which is hereby incorporated by reference in its entirety.

INTRODUCTION

The disclosure relates to a composite textile.

Textiles, such as fabrics and other fiber-based materials, may be formed from natural and/or synthetic fibers and may be useful for apparel and equipment applications requiring both comfort and functionality. For example, high-performance athletic equipment formed from textiles may be used in harsh environments in which the textile is exposed to heat, tensile forces, and strain. Such applications may therefore require textiles having excellent appearance, breathability, strength, elasticity, grip, and durability. Under certain conditions, such textiles may also experience changes in shape and mechanical properties. For example, textile shoelaces may stretch, come untied, or loosen during athletic activities.

SUMMARY

A composite textile includes a first layer formed from a two-yarn composite that includes a first yarn formed from a plurality of meta-aramid fibers and a second yarn formed from a plurality of polyester fibers. The first layer extends along a longitudinal axis. The composite textile also includes a second layer formed from the two-yarn composite and abutting the first layer along the longitudinal axis. The first yarn has a first surface having a first surface finish, and the second yarn has a second surface spaced opposite the first surface and having a second surface finish that is smoother than the first surface finish. The first yarn includes a plurality of hooks each extending from the first surface toward the second surface. The first layer includes a first plurality of micro-ridges disposed along the first surface and the second layer includes a second plurality of micro-ridges disposed along the second surface. The first plurality of micro-ridges and the second plurality of micro-ridges interact to generate friction between the first layer and the second layer and limit movement of the first layer and the second layer with respect to one another as the composite textile extends along the longitudinal axis in response to a tensile force.

In one aspect, the plurality of meta-aramid fibers may be present in the composite textile in a quantity of from 30 parts to 95 parts based on 100 parts of the composite textile.

In an additional aspect, the plurality of polyester fibers may be present in the composite textile in an amount of from 5 parts to 70 parts based on 100 parts of the composite textile.

In another aspect, the first layer and the second layer may align along the longitudinal axis such that the first plurality of micro-ridges and the second plurality of micro-ridges contact one another when one of the first layer and the second layer moves along the longitudinal axis with respect to another of the first layer and the second layer in response to the tensile force.

In a further aspect, the plurality of hooks may attach to the second surface along the longitudinal axis to limit movement of one of the first layer and the second layer with respect to another of the first layer and the second layer along the longitudinal axis in response to the tensile force.

In one aspect, each of the plurality of hooks may have a height of from 1 micron to 50 microns.

In an additional aspect, the first yarn may be braided with the second yarn about the longitudinal axis.

In another aspect, the first yarn may be woven with the second yarn about the longitudinal axis.

In a further aspect, the first yarn may be knitted with the second yarn about the longitudinal axis.

In one aspect, the composite article may further include at least one additional layer formed from the two-yarn composite and abutting the second layer along the longitudinal axis to therefore sandwich the second layer between the first layer and the at least one additional layer.

In an additional aspect, the first yarn may have a yarn count of 21 meta-aramid fibers and a single ply, and the second yarn may be a spun yarn.

In another aspect, a shoelace may be formed from the composite textile and may include an aglet disposed at each end of the shoelace.

In a further aspect, the shoelace may have a width of from 3 millimeters (mm) to 30 mm.

In one aspect, a fabric may be formed from the composite textile.

In another embodiment, a composite textile includes a first layer formed from a two-yarn composite that includes a first yarn formed from a plurality of meta-aramid fibers and a second yarn formed from a plurality of polyester fibers. The first layer extends along a longitudinal axis. The composite textile also includes a second layer formed from the two-yarn composite and abutting the first layer along the longitudinal axis. The composite textile further includes a third layer formed from the two-yarn composite and abutting the second layer along the longitudinal axis to thereby sandwich the second layer between the first layer and the second layer. The plurality of meta-aramid fibers and the plurality of polyester fibers are present in the composite textile in a ratio of a quantity of the plurality of meta-aramid fibers to an amount of the plurality of polyester fibers of from 5:95 to 95:5. The first yarn has a first surface and the second yarn has a second surface spaced opposite the first surface, and the first yarn includes a plurality of hooks each extending from the first surface toward the second surface. The first layer includes a first plurality of micro-ridges disposed along the first surface and the second layer includes a second plurality of micro-ridges disposed along the second surface. The first plurality of micro-ridges and the second plurality of micro-ridges interact to generate friction between the first layer and the second layer and limit movement of the first layer and the second layer with respect to one another as the composite textile extends along the longitudinal axis in response to a tensile force.

In one aspect, the first layer and the second layer may include the first yarn arranged in a first zig-zag pattern along a first horizontal axis that is perpendicular to the longitudinal axis. The first layer and the second layer may include the second yarn arranged in a second zig-zag pattern that abuts the first zig-zag pattern along a second horizontal axis that is parallel to the first horizontal axis.

In an additional aspect, the first layer and the second layer may include the first yarn and the second yarn arranged in a staggered pattern along an axis that is oblique to the longitudinal axis.

In another aspect, the first layer and the second layer may align along the longitudinal axis such that the first plurality of micro-ridges and the second plurality of micro-ridges contact one another when the first layer translates along the longitudinal axis with respect to the second layer in response to the tensile force.

In a further aspect, the plurality of hooks may attach to the second surface along the longitudinal axis to limit translation of the first layer with respect to the second layer along the longitudinal axis in response to the tensile force.

In a further embodiment, a composite textile includes a first layer formed from a two-yarn composite that includes a first yarn formed from a plurality of meta-aramid fibers and a second yarn formed from a plurality of polyester fibers, wherein the first layer extends along a longitudinal axis. The composite textile also includes a second layer formed from the two-yarn composite and abutting the first layer along the longitudinal axis. The plurality of meta-aramid fibers and the plurality of polyester fibers are present in the composite textile in a ratio of a quantity of the plurality of meta-aramid fibers to an amount of the plurality of polyester fibers of from 5:95 to 95:5. The first yarn has a first surface having a first surface finish, a yarn count of 21 meta-aramid fibers, and a single ply. The second yarn is a spun yarn and has a second surface spaced opposite the first surface and having a second surface finish that is smoother than the first surface finish. The first yarn includes a plurality of hooks each extending from the first surface toward the second surface and having a height of from 1 micron to 50 microns. The first layer includes a first plurality of micro-ridges disposed along the first surface and the second layer includes a second plurality of micro-ridges disposed along the second surface. The first plurality of micro-ridges and the second plurality of micro-ridges contact one another to generate friction between the first layer and the second layer and limit movement of the first layer and the second layer with respect to one another as the composite textile extends along the longitudinal axis in response to a tensile force. The plurality of hooks attach to the second surface along the longitudinal axis to limit movement of one of the first layer and the second layer with respect to another of the first layer and the second layer along the longitudinal axis in response to the tensile force.

The above features and advantages, and other features and attendant advantages of this disclosure, will be readily apparent from the following detailed description of illustrative examples and modes for carrying out the present disclosure when taken in connection with the accompanying drawings and the appended claims. Moreover, this disclosure expressly includes combinations and sub-combinations of the elements and features presented above and below.

DETAILED DESCRIPTION

Figure 1:
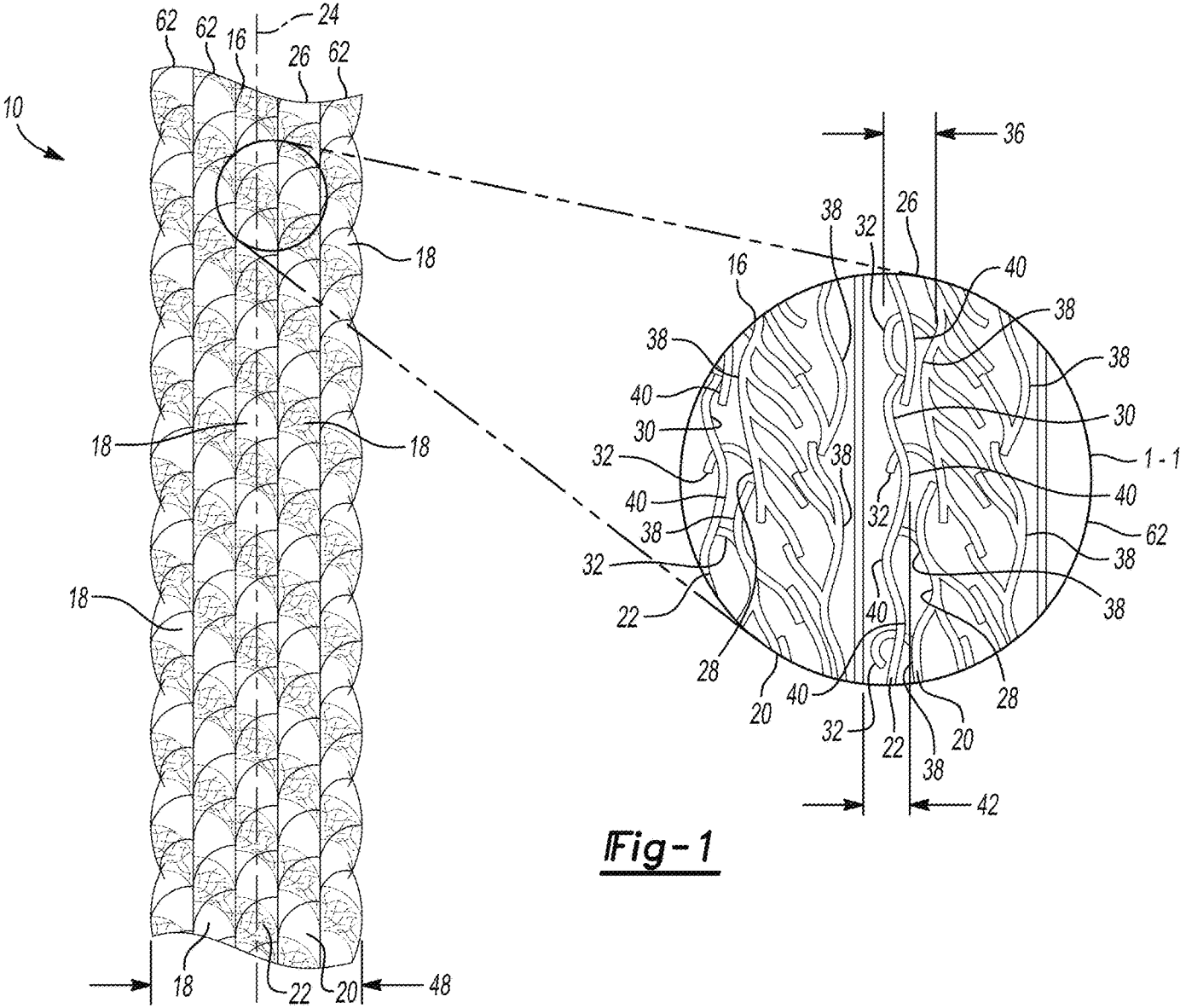
FIG. 1 is a schematic illustration of a plan view of a composite textile including a two-yarn composite shown in a magnified portion at 1-1.

Referring to the Figures, wherein like reference numerals refer to like elements, a composite textile 10 (FIG. 1) is shown generally. The composite textile 10 may be useful for forming, for example, athletic recovery, support, and fastening equipment having excellent aesthetics, durability, and comfort. In particular, the composite textile 10 may be useful for forming high-performance fabrics 12 (FIG. 3) and shoelaces 14 (FIG. 2) that require excellent tensile strength, elasticity, grip, flame retardance, performance, and reliability.

Figure 3:
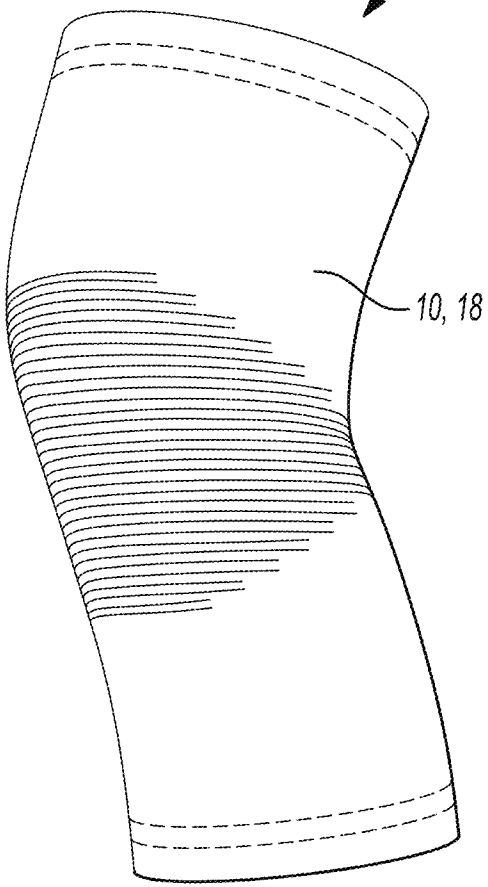
FIG. 3 is a schematic illustration of a perspective view of a fabric formed from the composite textile of FIG. 1.
Figure 2:
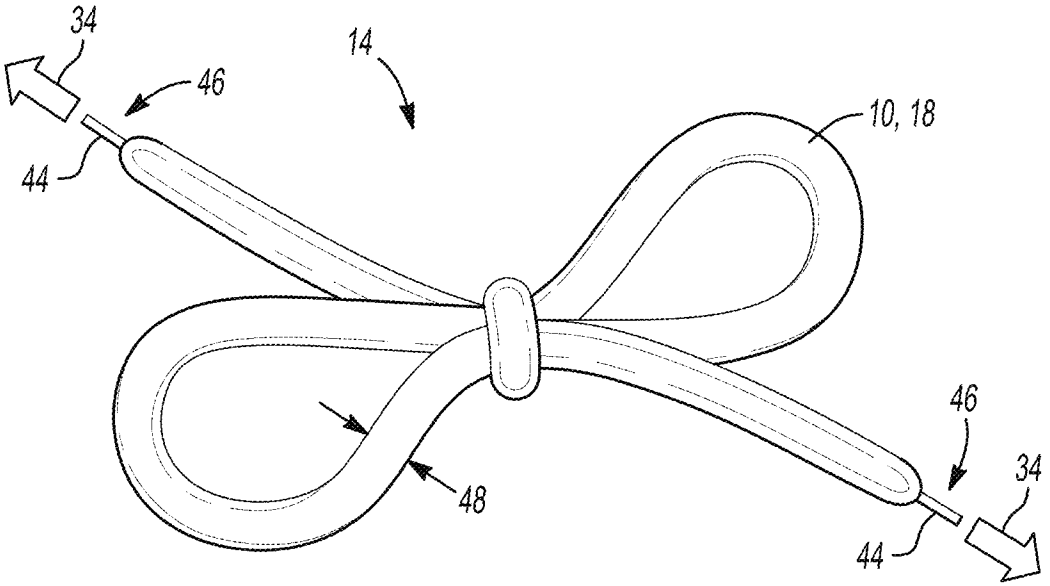
FIG. 2 is a schematic illustration of a perspective view of a shoelace formed from the composite textile of FIG. 1.

Referring to FIGS. 2 and 3, the composite textile 10 may be useful for consumer products and sporting goods applications such as, but not limited to, shoelaces 14 (FIG. 2); fabric 12 (FIG. 3) for athletic braces such as knee, ankle, shoulder, elbow, wrist, and knee braces; athletic tapes; ankle ties or foot straps for rowing applications; gloves; sleeves; cloths; stitching; and the like. In one non-limiting example, the composite textile 10 may be useful for forming shoelaces 14 for industrial footwear applications such as safety boots, footwear for law enforcement, fire retardant footwear, and the like; for footwear worn while participating in sports such as tennis, basketball, soccer, football, track and field, cross-country running, and hockey; for footwear worn while participating in leisure activities such as walking, running, and hiking; and for footwear designed for children, elderly, and individuals with a disability. More specifically, shoelaces 14 formed from the composite textile 10 have excellent grip, resistance to loosening, i.e., untie-resistance, tensile strength, elasticity, cut-resistance, and flame-resistance, as set forth in more detail below.

Alternatively, the composite textile 10 may be useful for other non-sporting goods applications, such as, but not limited to, packaging materials, such as netting and twine; fastening materials, such as cables, straps, ropes, and lacing; tooling applications, such as cabling, stitching, and fasteners; industrial clothing, such as protective garments, aprons, reinforcement stitching, and industrial workwear; and medical devices, such as support garments, compression sleeves, and the like.

Composite Textile

Referring now to FIG. 1, the composite textile 10 includes a first layer 16 formed from a two-yarn composite 18 that includes a first yarn 20 formed from a plurality of meta-aramid fibers and a second yarn 22 formed from a plurality of polyester fibers. That is, the first layer 16 is a composite formed from two yarns 20, 22. The first yarn 20 may have a yarn count of 21 meta-aramid fibers and a single ply and may be classified as 21*s*/1 meta-aramid fiber yarn. The second yarn 22 may be a spun yarn and may be classified as a spun polyester yarn. Further, the first layer 16 formed from the two-yarn composite 18 extends along a longitudinal axis 24. That is, the first layer 16 may extend lengthwise along an article.

Referring again to FIG. 1, the composite textile 10 also includes a second layer 26 formed from the two-yarn composite 18 and abutting the first layer 16 along the longitudinal axis 24. That is, the second layer 26 is formed from the two-yarn composite 18 that includes the first yarn 20 formed from the plurality of meta-aramid fibers and the second yarn 22 formed from the plurality of polyester fibers and contacts the first layer 16. For example, the first yarn 20 may braided with the second yarn 22 about the longitudinal axis 24. That is, three or more strands of the first yarn 20 and the second yarn 22 may be interwoven diagonally to create a strong, flexible cord or shoelace 14 (FIG. 2) formed from the composite textile 10.

In another non-limiting example, the first yarn 20 may be woven with the second yarn 22 about the longitudinal axis 24. For example, fabric 12 (FIG. 3) may be formed from the composite textile 10. That is, the first yarn 20 and the second yarn 22 may be interlaced vertically (warp) and horizontally (weft) at right angles to create the fabric 12 (FIG. 3) formed from the composite textile 10. In another non-limiting example, the first yarn 20 may be knitted with the second yarn 22 about the longitudinal axis 24. That is, the first yarn 20 and second yarn 22 may form loops in rows (weft) or columns (warp) to create the fabric 12 formed from the composite textile 10.

Referring again to FIG. 1 and best shown at magnified portion 1-1, the first yarn 20 has a first surface 28 having a first surface finish. Further, the second yarn 22 has a second surface 30 spaced opposite the first surface 28 and having a second surface finish that is smoother than the first surface finish. That is, the first yarn 20 may have a comparatively coarse surface finish and the second yarn 22 may have a comparatively smooth surface finish.

More specifically, as best shown at magnified portion 1-1 of FIG. 1, the first yarn 20 includes a plurality of hooks 32 each extending from the first surface 28 toward the second surface 30. The plurality of hooks 32 may attach to the second surface 30 along the longitudinal axis 24 to limit movement of one of the first layer 16 and the second layer 26 with respect to another one of the first layer 16 and the second layer 26 along the longitudinal axis 24 in response to a tensile force 34 (FIG. 2). For example, the plurality of hooks 32 may attach to the second surface 30 along the longitudinal axis 24 to limit translation of the first layer 16 with respect to the second layer 26 along the longitudinal axis 24 in response to the tensile force 34. That is, the plurality of hooks 32 may engage with the second surface 30 to anchor the first yarn 20 with respect to the second yarn 22 along the longitudinal axis 24 to thereby limit undesired stretching or elongation of the composite textile 10. For embodiments in which the shoelace 14 (FIG. 2) is formed from the composite textile 10, such limited translation along the longitudinal axis 24 may contribute to an excellent resistance to undesired loosening or untying of the shoelace 14 during use and may enhance an ability of the shoelace to remain tied or fastened.

Each of the plurality of hooks 32 may be measured on a micron or micrometer scale, i.e., $1\times10^{-6}$ meters. For example, each of the plurality of hooks 32 may have a height 36 (FIG. 1 at 1-1) of from 1 micron to 50 microns, or from 5 microns to 45 microns, or from 10 microns to 40 microns, or from 20 microns to 30 microns. Hooks 32 having a height 36 that is less than 1 micron or greater than 50 microns may be unsuitable for extending towards or effectively contacting the second surface 30 to thereby limit translation along the longitudinal axis 24.

As described with continued reference to magnified portion 1-1 of FIG. 1, the first layer 16 also includes a first plurality of micro-ridges 38 disposed along the first surface 28, and the second layer 26 includes a second plurality of micro-ridges 40 disposed along the second surface 30. The first plurality of micro-ridges 38 and the second plurality of micro-ridges 40 interact to generate friction between the first layer 16 and the second layer 26 and limit movement of the first layer 16 and the second layer 26 with respect to one another as the composite textile 10 extends along the longitudinal axis 24 in response to the tensile force 34 (FIG. 2). That is, the first layer 16 and the second layer 26 may align along the longitudinal axis 24 such that the first plurality of micro-ridges 38 and the second plurality of micro-ridges 40 contact one another when one of the first layer 16 and the second layer 26 moves along the longitudinal axis 24 with respect to one another of the first layer 16 and the second layer 26 in response to the tensile force 34. For example, the first layer 16 and the second layer 26 may align along the longitudinal axis 24 such that the first plurality of micro-ridges 38 and the second plurality of micro-ridges 40 contact and minimize or prevent sliding when the first layer 16 translates or moves along the longitudinal axis 24 with respect to the second layer 26 in response to the tensile force 34. That is, the first plurality of micro-ridges 38 and the second plurality of micro-ridges 40 may abut and interlock with one another to anchor the first yarn 20 with respect to the second yarn 22 along the longitudinal axis 24 and thereby limit undesired stretching or elongation of the composite textile 10. For embodiments in which the shoelace 14 (FIG. 2) is formed from the composite textile 10, such limited translation along the longitudinal axis 24 may contribute to an excellent resistance to loosening of the shoelace 14 and may enhance an ability of the shoelace to remain tied or fastened during use.

Each of the first plurality of micro-ridges 38 and the second plurality of micro-ridges 40 may also be measured on a micron or micrometer scale. For example, each of the first plurality of micro-ridges 38 and the second plurality of micro-ridges 40 may have a height 42 (FIG. 1 at 1-1) of from 1 micron to 50 microns, or from 5 microns to 45 microns, or from 10 microns to 40 microns, or from 20 microns to 30 microns. Micro-ridges 38, 40 having a height 42 that is less than 1 micron may be unsuitable for interacting to generate friction between the first layer 16 and the second layer 26 to thereby limit translation along the longitudinal axis 24 in response to the tensile force 34, and may instead slide over one another to permit translation along the longitudinal axis 24. Likewise, micro-ridges 38, 40 having a height 42 that is greater than 50 microns may interfere with one another and prevent a smooth appearance or other desired aesthetic of the shoelace 14.

Fiber Ratios

Referring again to the two-yarn composite 18 of the composite textile 10, the plurality of meta-aramid fibers may be present in the composite textile 10 in a quantity of from 30 parts to 95 parts, or from 35 parts to 90 parts, or from 40 parts to 80 parts, or from 55 parts to 70 parts, based on 100 parts of the composite textile 10. Conversely, the plurality of polyester fibers may be present in the composite textile 10 in an amount of from 5 parts to 70 parts, or from 10 parts to 65 parts, or from 20 parts to 60 parts, or from 30 parts to 45 parts, based on 100 parts of the composite textile 10. Stated differently, in some embodiments, the plurality of meta-aramid fibers and the plurality of polyester fibers are present in the composite textile 10 in a ratio or proportion of the quality of the plurality of meta-aramid fibers to the amount of the plurality of polyester fibers of from 5:95 to 95:5, or from 15:85 to 85:15, or from 20:80 to 80:20, or from 30:70 to 70:30, or from 40:60 to 60:40, or from 45:55 to 55:45.

Each of the aforementioned quantities, amounts, and ratios may be critical for specific applications and desired performance properties of the composite textile 10, as set forth in more detail below. As such, textiles that include the plurality of meta-aramid fibers and the plurality of polyester fibers present in the composite textile 10 in a ratio or proportion of less than from 5:95 or greater than 95:5 may have unsuitable grip, be susceptible to loosening, have low tensile strength and elasticity, have an undesirable weight, and/or have low flame-resistance.

Shoelace Applications

As a non-limiting example described with reference to FIG. 2, for certain applications, the shoelace 14 may be formed form the composite textile 10 and may include an aglet 44 disposed at each end 46 of the shoelace 14. The shoelace 14 may have a width 48 of from 3 millimeters (mm) to 30 mm, or from 6 mm to 15 mm, or 7 mm, or 8 mm, depending on a desired use and application of the shoelace 14. Further, the shoelace 14 may have a flat or round shape. At widths 48 of less than 3 mm or greater than 30 mm, the shoelace 14 may not exhibit adequate untie-resistance, tensile strength, elasticity, or flame-resistance.

As a non-limiting example, shoelaces 14 useful for lacing tennis footwear may have a width 48 of 8 mm and may include 80 parts of the plurality of meta-aramid fibers and 20 parts of the plurality of polyester fibers based on 100 parts of the composite textile 10. At this fiber loading quantity and amount, the shoelace 14 may have comparatively very high untie-resistance, comparatively very high tensile strength, comparatively low elasticity, comparatively low flame-resistance, a comparatively moderately heavy weight, and a median melting temperature of about 50° C.

For shoelaces 14 useful for lacing basketball footwear, the shoelace 14 may be round, have a width 48 of 6 mm, and may include 55 parts of the plurality of meta-aramid fibers and 45 parts of the plurality of polyester fibers based on 100 parts of the composite textile 10. At this fiber loading quantity and amount, the shoelace 14 may have comparatively moderately high untie-resistance, comparatively high tensile strength, comparatively high elasticity, comparatively high flame-resistance, a comparatively light weight, and a median melting temperature of about 110° C.

For shoelaces 14 useful for lacing soccer footwear, the shoelace 14 may have a width 48 of 6 mm and may include 80 parts of the plurality of meta-aramid fibers and 20 parts of the plurality of polyester fibers based on 100 parts of the composite textile 10. At this fiber loading quantity and amount, the shoelace 14 may have comparatively very high untie-resistance, comparatively very high tensile strength, comparatively high elasticity, comparatively moderate flame-resistance, a comparatively very light weight, and a median melting temperature of about 50° C.

For shoelaces 14 useful for lacing American football footwear that is predominately useful for kicking a football, the shoelace 14 may have a width 48 of 6 mm and may include 80 parts of the plurality of meta-aramid fibers and 20 parts of the plurality of polyester fibers based on 100 parts of the composite textile 10. At this fiber loading quantity and amount, the shoelace 14 may have comparatively very high untie-resistance, comparatively very high tensile strength, comparatively high elasticity, comparatively moderate flame-resistance, a comparatively very light weight, and a median melting temperature of about 50° C.

For shoelaces 14 useful for lacing American football footwear that is predominately useful for running, the shoelace 14 may have a width 48 of 7 mm and may include 40 parts of the plurality of meta-aramid fibers and 60 parts of the plurality of polyester fibers based on 100 parts of the composite textile 10. At this fiber loading quantity and amount, the shoelace 14 may have comparatively very high untie-resistance, comparatively high tensile strength, comparatively low elasticity, comparatively high flame-resistance, a comparatively light weight, and a median melting temperature of about 150° C.

For shoelaces 14 useful for lacing running footwear, the shoelace 14 may have a width 48 of 7 mm and may include 40 parts of the plurality of meta-aramid fibers and 60 parts of the plurality of polyester fibers based on 100 parts of the composite textile 10. At this fiber loading quantity and amount, the shoelace 14 may have comparatively very high untie-resistance, comparatively high tensile strength, comparatively low elasticity, comparatively high flame-resistance, a comparatively light weight, and a median melting temperature of about 150° C.

In another example of shoelaces 14 useful for lacing running footwear, the shoelace 14 may have a width 48 of 7 mm and may include 5 parts of the plurality of meta-aramid fibers and 95 parts of the plurality of polyester fibers based on 100 parts of the composite textile 10. As this fiber loading quantity and amount, the shoelace 14 may have comparatively very high untie-resistance, comparatively high tensile strength, comparatively very high elasticity, comparatively low flame-resistance, a comparatively light weight, and a median melting temperature of about 90° C.

For shoelaces 14 useful for lacing track footwear, the shoelace 14 may have a width 48 of 6 mm and may include 70 parts of the plurality of meta-aramid fibers and 30 parts of the plurality of polyester fibers based on 100 parts of the composite textile 10. At this fiber loading quantity and amount, the shoelace 14 may have comparatively very high untie-resistance, comparatively very high tensile strength, comparatively very low elasticity, comparatively moderate flame-resistance, a comparatively very light weight, and a median melting temperature of about 75° C.

For shoelaces 14 useful for lacing industrial footwear, the shoelace 14 may be round, may have a width 48 of 6 mm, and may include 85 parts of the plurality of meta-aramid fibers and 15 parts of the plurality of polyester fibers based on 100 parts of the composite textile 10. At this fiber loading quantity and amount, the shoelace 14 may have comparatively very high untie-resistance, comparatively very high tensile strength, comparatively moderate elasticity, comparatively very high flame-resistance, a comparatively moderately heavy weight, and a median melting temperature of about 480° C. That is, the shoelace 14 may be thermally stable.

For shoelaces 14 useful for lacing hockey footwear, the shoelace 14 may have a width 48 of 15 mm and may include 30 parts of the plurality of meta-aramid fibers and 70 parts of the plurality of polyester fibers based on 100 parts of the composite textile 10. At this fiber loading quantity and amount, the shoelace 14 may have comparatively very high untie-resistance, comparatively moderately high tensile strength, comparatively low elasticity, comparatively high flame-resistance, a comparatively light weight, and a median melting temperature of about 175° C.

For laces 14 useful as ankle ties for rowing, the lace 14 may have a width 48 of 3 mm and may include 85 parts of the plurality of meta-aramid fibers and 15 parts of the plurality of polyester fibers based on 100 parts of the composite textile 10. At this fiber loading quantity and amount, the lace 14 may have comparatively very high untie-resistance, comparatively very high tensile strength, comparatively moderate elasticity, comparatively low flame-resistance, a comparatively very light weight, and a median melting temperature of about 40° C. Tables 1-3 summarize the aforementioned properties.

TABLE 1

| FOOT-WEAR | WIDTH (mm) | ARAMID % | POLY-ESTER % | UNTIE-RESISTANCE | TENSILE STRENGTH |
|---|---|---|---|---|---|
| Hockey | 15 | 30 | 70 | very high | moderately high |
| Football (Running) | 7 | 40 | 60 | very high | high |
| Running | 7 | 40 | 60 | very high | high |
| Running | 7 | 5 | 95 | very high | high |
| Basketball | round/6 | 55 | 45 | moderately high | high |
| Track | 6 | 70 | 30 | very high | very high |
| Tennis | 8 | 80 | 20 | very high | very high |
| Soccer | 6 | 80 | 20 | very high | very high |
| Football (Kicking) | 6 | 80 | 20 | very high | very high |
| Industrial | round/6 | 85 | 15 | very high | very high |
| Rowing | 3 | 85 | 15 | very high | very high |

TABLE 2

| FOOT-WEAR | WIDTH (mm) | ARAMID % | POLY-ESTER % | ELAS-TICITY | FLAME-RESISTANCE |
|---|---|---|---|---|---|
| Hockey | 15 | 30 | 70 | low | high |
| Football (Running) | 7 | 40 | 60 | low | high |
| Running | 7 | 40 | 60 | low | high |
| Running | 7 | 5 | 95 | very high | low |
| Basketball | round/6 | 55 | 45 | high | high |
| Track | 6 | 70 | 30 | very low | moderate |
| Tennis | 8 | 80 | 20 | low | low |
| Soccer | 6 | 80 | 20 | high | moderate |
| Football (Kicking) | 6 | 80 | 20 | high | moderate |
| Industrial | round/6 | 85 | 15 | moderate | very high |
| Rowing | 3 | 85 | 15 | moderate | low |

TABLE 3

| FOOT-WEAR | WIDTH (mm) | ARAMID % | POLY-ESTER % | WEIGHT | MEDIAN MELTING TEMP. (° C.) |
|---|---|---|---|---|---|
| Hockey | 15 | 30 | 70 | light | 175 |
| Football (Running) | 7 | 40 | 60 | light | 150 |
| Running | 7 | 40 | 60 | light | 150 |
| Running | 7 | 5 | 95 | light | 90 |
| Basketball | round/6 | 55 | 45 | light | 110 |
| Track | 6 | 70 | 30 | very light | 75 |
| Tennis | 8 | 80 | 20 | moderately heavy | 50 |
| Soccer | 6 | 80 | 20 | very light | 50 |
| Football (Kicking) | 6 | 80 | 20 | very light | 50 |
| Industrial | round/6 | 85 | 15 | moderately heavy | 480 |
| Rowing | 3 | 85 | 15 | very light | 40 |

Referring to Tables 1-3, when comparing the data for shoelaces 14 useful for lacing basketball and industrial footwear, for a given round shape and width 48 of 6 mm, as the quantity of the plurality of meta-aramid fibers substantially increases in the composite textile 10, i.e., from 55 parts to 85 parts, untie-resistance, tensile strength, flame-resistance, weight, and median melting temperature increase. However, elasticity decreases.

Similarly, and again referring to Tables 1-3, when comparing the data for shoelaces 14 useful for lacing track and American football (kicking) footwear, for a given width 48 of 6 mm, as the quantity of the plurality of meta-aramid fibers increases slightly in the composite textile 10, i.e., from 70 parts to 80 parts, elasticity substantially increases and the median melting temperature decreases.

With continued reference to Tables 1-3, when comparing the data for shoelaces 14 useful for lacing tennis and soccer footwear, for a given quantity of the plurality of meta-aramid fibers in the composite textile 10, i.e., 80 parts, as the width 48 decreases from 8 mm to 6 mm, elasticity and flame-resistance increase and weight substantially decreases.

In addition, when comparing the data for shoelaces 14 useful for lacing footwear for running, for a given width 48 of shoelace 14, as the quantity of the plurality of meta-aramid fibers in the composite textile 10 increases from 5 parts to 40 parts, elasticity substantially decreases, flame-resistance increases, and the median melting temperature increases. Stated differently, for a given width 48 of shoelace 14, as the amount of the plurality of polyester fibers in the composite textile 10 increases from 60 parts to 95 parts, elasticity substantially increases, flame-resistance decreases, and the median melting temperature decreases.

Configurations of the Composite Textile

Figure 4:
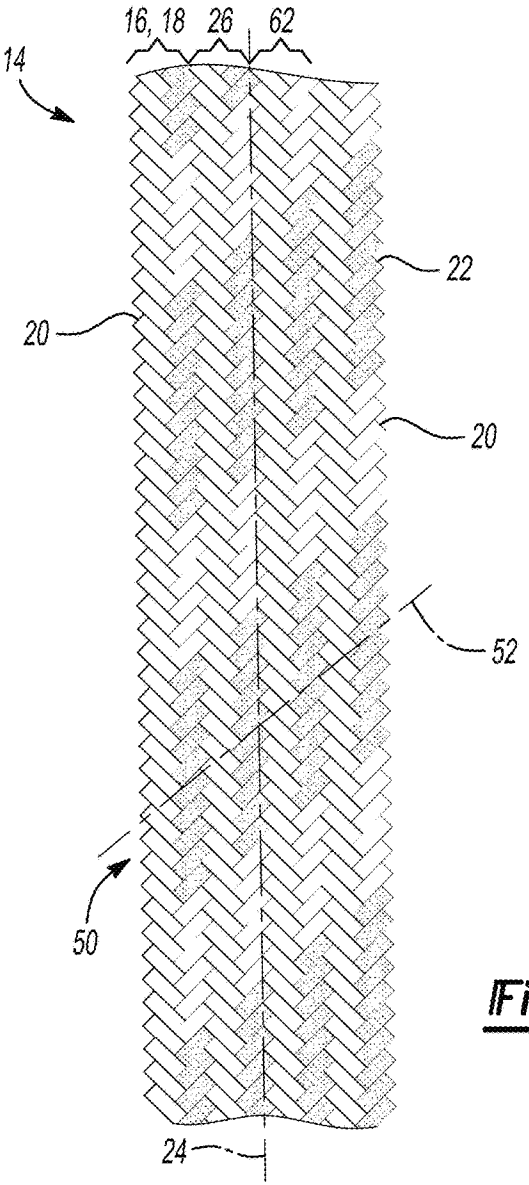
FIG. 4 is a schematic illustration of a plan view of a portion of one configuration of the shoelace of FIG. 2, wherein the two-yarn composite is arranged in a staggered pattern.

Referring now to FIGS. 4-7, for certain shoelaces 14 or other applications, e.g., fabric 12 (FIG. 3), the first yarn 20 and the second yarn 22 may be arranged in distinct configurations according to desired mechanical properties, performance, and aesthetics. Referring to FIG. 4, in one non-limiting configuration, the first layer 16 and the second layer 26 may include the first yarn 20 and the second yarn 22 arranged in a staggered pattern 50 along an axis 52 that is oblique to the longitudinal axis 24. That is, the staggered pattern 50 may form a series of alternating diagonal hashes or stripes on the shoelace 14. Such alternating yarns 20, 22 staggered along the oblique axis 52 may enhance the frictional interaction between the first yarn 20 and the second yarn 22 and between the first layer 16 and the second layer 26 to thereby limit translation along the longitudinal axis 24. Further, although shown with a ratio or proportion of more first yarn 20 than second yarn 22 in FIG. 4, the shoelace 14 may alternatively include more second yarn 22 than first yarn 20 or an equal amount of first and second yarn 20, 22.

Figure 5:
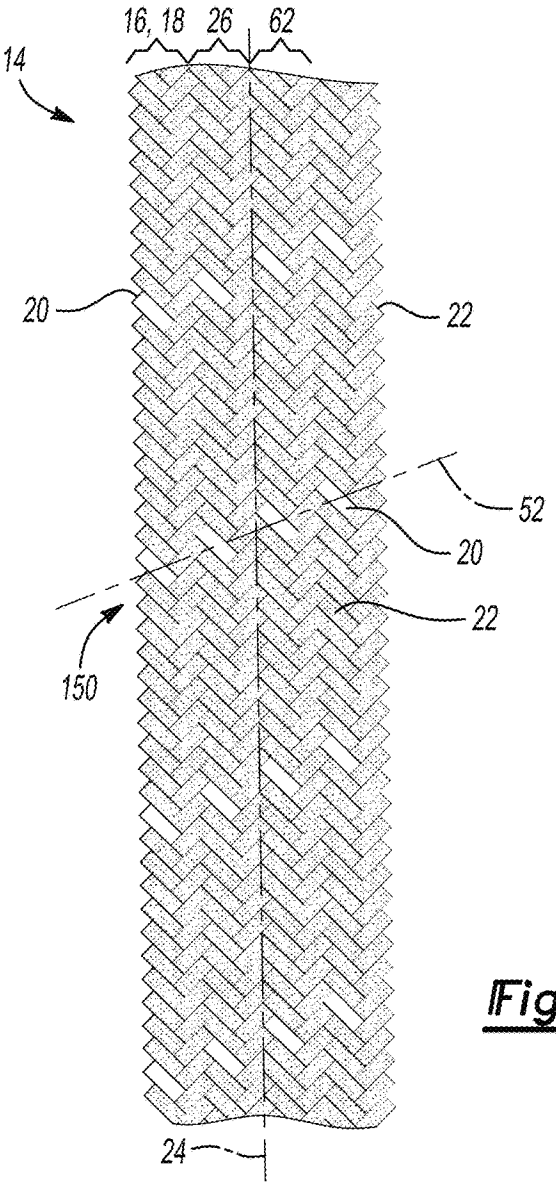
FIG. 5 is a schematic illustration of a plan view of a portion of another configuration of the shoelace of FIG. 2, wherein the two-yarn composite is arranged in another staggered pattern.

Referring to FIG. 5, in another non-limiting configuration, the first layer 16 and the second layer 26 may include the first yarn 20 and the second yarn 22 arranged in another staggered pattern 150 along the axis 52 that is oblique to the longitudinal axis 24. That is, the staggered pattern 150 may form a series of alternating diagonal dots or hash marks on the shoelace 14. Such alternating yarns 20, 22 staggered along the oblique axis 52 may enhance the frictional interaction between the first yarn 20 and the second yarn 22 and between the first layer 16 and the second layer 26 to thereby limit translation along the longitudinal axis 24. Further, although shown with a ratio or proportion of more second yarn 22 than first yarn 20 in FIG. 5, the shoelace 14 may alternatively include more first yarn 20 than second yarn 22 or an equal amount of first and second yarn 20, 22.

Figure 6:
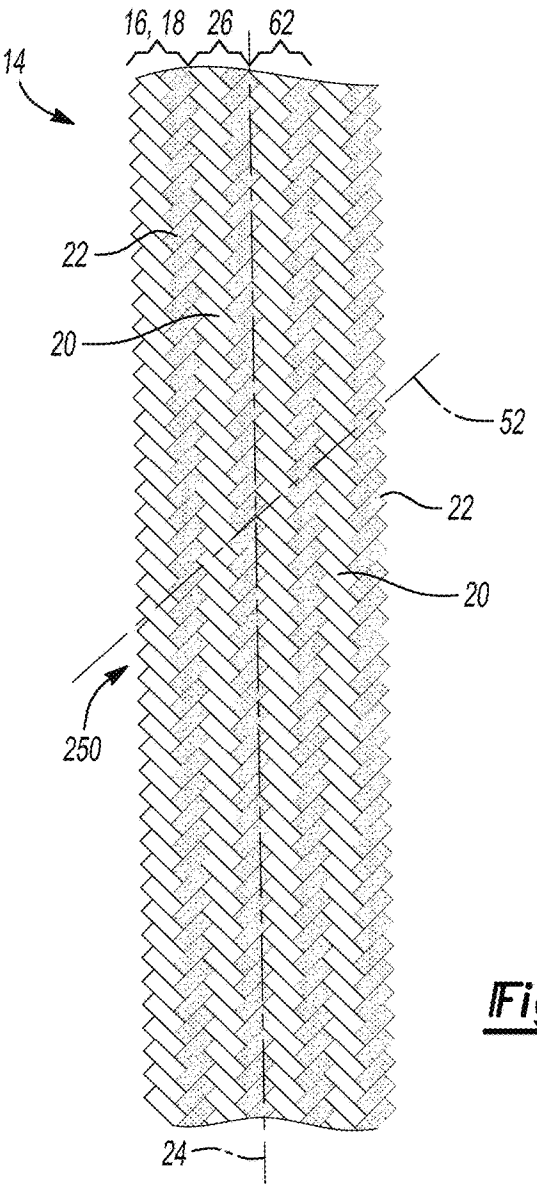
FIG. 6 is a schematic illustration of a plan view of a portion of yet another configuration of the shoelace of FIG. 2, wherein the two-yarn composite is arranged in yet another staggered pattern.

Referring to FIG. 6, in yet another non-limiting configuration, the first layer 16 and the second layer 26 may include the first yarn 20 and the second yarn 22 arranged in yet another staggered pattern 250 along the axis 52 that is oblique to the longitudinal axis 24. That is, the staggered pattern 250 may form a series of alternating diagonal or vertical stripes on the shoelace 14. Such alternating yarns 20, 22 staggered along the oblique axis 52 may enhance the frictional interaction between the first yarn 20 and the second yarn 22 and between the first layer 16 and the second layer 26 to thereby limit translation along the longitudinal axis 24. Further, although shown with a ratio or proportion of equal amounts of first yarn 20 and second yarn 22 in FIG. 6, the shoelace 14 may alternatively include more first yarn 20 than second yarn 22 or more second yarn 22 than first yarn 20.

Figure 7:
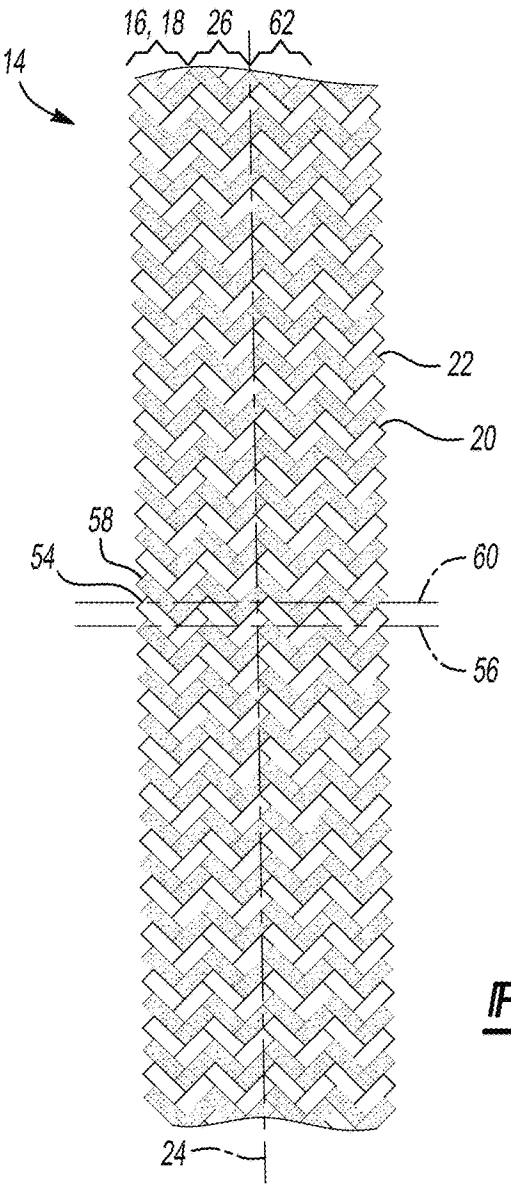
FIG. 7 is a schematic illustration of a plan view of a portion of another configuration of the shoelace of FIG. 2, wherein the two-yarn composite is arranged in a zig-zag pattern.

Referring to FIG. 7, in a further non-limiting configuration, the first layer 16 and the second layer 26 may include the first yarn 20 arranged in a first zig-zag pattern 54 along a first horizontal axis 56 that is perpendicular to the longitudinal axis 24. In addition, the first layer 16 and the second layer 26 may include the second yarn 22 arranged in a second zig-zag pattern 58 that abuts the first zig-zag pattern 54 along a second horizontal axis 60 that is parallel to the first horizontal axis 56. That is, the shoelace 14 may appear to have alternating zig-zag patterns 54, 58. Such alternating yarns 20, 22 arranged in the zig-zag patterns 54, 58 may enhance the frictional interaction between the first yarn 20 and the second yarn 22 and between the first layer 16 and the second layer 26 to thereby limit translation along the longitudinal axis 24 in response to the tensile force 34 (FIG. 2).

Referring again to FIG. 1, the composite textile 10 may further include at least one additional layer 62 formed from the two-yarn composite 18 and abutting the second layer 26 along the longitudinal axis 24 to therefore sandwich the second layer 26 between the first layer 16 and the at least one additional layer 62. For example, the composite textile 10 may include a third layer 62 formed from the two-yarn composite 18 and abutting the second layer 26 along the longitudinal axis 24 to thereby sandwich the second layer 26 between the first layer 16 and the second layer 26. In some examples, the composite textile 10 may have four or five or six layers 62.

Therefore, in summary, due to both a) the interaction of the plurality of hooks 32, the first plurality of micro-ridges 38, and the second plurality of micro-ridges 40 to create frictional resistance to translation of the first layer 16 with respect to the second layer 26 along the longitudinal axis 24 in response to the tensile force 34 and b) the ratio of the plurality of meta-aramid fibers to the plurality of polyester fibers, the composite textile 10 may have excellent tensile strength, near-perfect elasticity, high grip, superior untie-resistance, and excellent flame retardance. As such, articles such as shoelaces 14 formed from the composite textile 10 are resistant to becoming untied during athletic activity and provide excellent comfort to a user. Other articles formed from the composite textile 10 such as athletic recovery equipment formed from fabric 12, e.g., athletic tapes and ankle braces, exhibit excellent strength, elasticity, and durability, enhance athletic performance, and aid in muscular recovery.

The described embodiments of the present disclosure are intended to serve as non-limiting examples, and other embodiments may take various and alternative forms. In addition, the appended drawings are not necessarily to scale, and may present a somewhat simplified representation of various features of the present disclosure, including, for example, specific dimensions, orientations, locations, and shapes. Details associated with such features will be determined in part by the intended application and use environment of the described embodiments.

For purposes of the present description, unless specifically disclaimed, use of the singular includes the plural and vice versa, the terms "and" and "or" shall be both conjunctive and disjunctive, and the words "including", "containing", "comprising", "having", and the like shall mean "including without limitation". Moreover, words of approximation such as "about", "substantially", "generally", "approximately", etc., may be used herein in the sense of "at, near, or nearly at", or "within 0-5% of", or "within acceptable manufacturing tolerances", or logical combinations thereof. As used herein, a component that is "configured to" perform a specified function is capable of performing the specified function without alteration, rather than merely having potential to perform the specified function after further modification. In other words, the described hardware, when expressly configured to perform the specified function, is specifically selected, created, implemented, utilized, programmed, and/or designed for the purpose of performing the specified function. In addition, the use of ordinals such as first, second and third does not necessarily imply a ranked sense of order, but rather may merely distinguish between multiple instances of an act or structure.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims. Moreover, this disclosure expressly includes combinations and sub-combinations of the elements and features presented above and below.

What is claimed is:

1. A composite textile comprising:

a first layer formed from a two-yarn composite that includes a first yarn formed from a plurality of meta-aramid fibers and a second yarn formed from a plurality of polyester fibers;

wherein the first layer extends along a longitudinal axis; and a second layer formed from the two-yarn composite and abutting the first layer along the longitudinal axis;

wherein the first yarn has a first surface having a first surface finish;

wherein the second yarn has a second surface spaced opposite the first surface and having a second surface finish that is smoother than the first surface finish;

wherein the first yarn includes a plurality of hooks each extending from the first surface toward the second surface;

wherein the first layer includes a first plurality of micro-ridges disposed along the first surface and the second layer includes a second plurality of micro-ridges disposed along the second surface; and wherein the first plurality of micro-ridges and the second plurality of micro-ridges interact to generate friction between the first layer and the second layer and limit movement of the first layer and the second layer with respect to one another as the composite textile extends along the longitudinal axis in response to a tensile force.

2. The composite textile of claim 1, wherein the plurality of meta-aramid fibers are present in the composite textile in a quantity of from 30 parts to 95 parts based on 100 parts of the composite textile.

3. The composite textile of claim 2, wherein the plurality of polyester fibers are present in the composite textile in an amount of from 5 parts to 70 parts based on 100 parts of the composite textile.

4. The composite textile of claim 1, wherein the first layer and the second layer align along the longitudinal axis such that the first plurality of micro-ridges and the second plurality of micro-ridges contact one another when one of the first layer and the second layer moves along the longitudinal axis with respect to another of the first layer and the second layer in response to the tensile force.

5. The composite textile of claim 1, wherein the plurality of hooks attach to the second surface along the longitudinal axis to limit movement of one of the first layer and the second layer with respect to another of the first layer and the second layer along the longitudinal axis in response to the tensile force.

6. The composite textile of claim 1, wherein each of the plurality of hooks have a height of from 1 micron to 50 microns.

7. The composite textile of claim 1, wherein the first yarn is braided with the second yarn about the longitudinal axis.

8. The composite textile of claim 1, wherein the first yarn is woven with the second yarn about the longitudinal axis.

9. The composite textile of claim 1, wherein the first yarn is knitted with the second yarn about the longitudinal axis.

10. The composite textile of claim 1, further including at least one additional layer formed from the two-yarn composite and abutting the second layer along the longitudinal axis to therefore sandwich the second layer between the first layer and the at least one additional layer.

11. The composite textile of claim 1, wherein the first yarn has a yarn count of 21 meta-aramid fibers and a single ply; and wherein the second yarn is a spun yarn.

12. A shoelace formed from the composite textile of claim 1 and including an aglet disposed at each end of the shoelace.

13. The shoelace of claim 12, wherein the shoelace has a width of from 3 millimeters (mm) to 30 mm.

14. A fabric formed from the composite textile of claim 1.

15. A composite textile comprising:

a first layer formed from a two-yarn composite that includes a first yarn formed from a plurality of meta-aramid fibers and a second yarn formed from a plurality of polyester fibers;

wherein the first layer extends along a longitudinal axis;

a second layer formed from the two-yarn composite and abutting the first layer along the longitudinal axis; and a third layer formed from the two-yarn composite and abutting the second layer along the longitudinal axis to thereby sandwich the second layer between the first layer and the second layer;

wherein the plurality of meta-aramid fibers and the plurality of polyester fibers are present in the composite textile in a ratio of a quantity of the plurality of meta-aramid fibers to an amount of the plurality of polyester fibers of from 5:95 to 95:5;

wherein the first yarn has a first surface and the second yarn has a second surface spaced opposite the first surface;

wherein the first yarn includes a plurality of hooks each extending from the first surface toward the second surface;

wherein the first layer includes a first plurality of micro-ridges disposed along the first surface and the second layer includes a second plurality of micro-ridges disposed along the second surface; and wherein the first plurality of micro-ridges and the second plurality of micro-ridges interact to generate friction between the first layer and the second layer and limit movement of the first layer and the second layer with respect to one another as the composite textile extends along the longitudinal axis in response to a tensile force.

16. The composite textile of claim 15, wherein the first layer and the second layer include the first yarn arranged in a first zig-zag pattern along a first horizontal axis that is perpendicular to the longitudinal axis; and wherein the first layer and the second layer include the second yarn arranged in a second zig-zag pattern that abuts the first zig-zag pattern along a second horizontal axis that is parallel to the first horizontal axis.

17. The composite textile of claim 15, wherein the first layer and the second layer include the first yarn and the second yarn arranged in a staggered pattern along an axis that is oblique to the longitudinal axis.

18. The composite textile of claim 15, wherein the first layer and the second layer align along the longitudinal axis such that the first plurality of micro-ridges and the second plurality of micro-ridges contact one another when the first layer translates along the longitudinal axis with respect to the second layer in response to the tensile force.

19. The composite textile of claim 18, wherein the plurality of hooks attach to the second surface along the longitudinal axis to limit translation of the first layer with respect to the second layer along the longitudinal axis in response to the tensile force.

20. A composite textile comprising:

a first layer formed from a two-yarn composite that includes a first yarn formed from a plurality of meta-aramid fibers and a second yarn formed from a plurality of polyester fibers;

wherein the first layer extends along a longitudinal axis; and a second layer formed from the two-yarn composite and abutting the first layer along the longitudinal axis;

wherein the plurality of meta-aramid fibers and the plurality of polyester fibers are present in the composite textile in a ratio of a quantity of the plurality of meta-aramid fibers to an amount of the plurality of polyester fibers of from 5:95 to 95:5;

wherein the first yarn has a first surface having a first surface finish;

wherein the first yarn has a yarn count of 21 meta-aramid fibers and a single ply;

wherein the second yarn is a spun yarn and has a second surface spaced opposite the first surface and having a second surface finish that is smoother than the first surface finish;

wherein the first yarn includes a plurality of hooks each extending from the first surface toward the second surface and having a height of from 1 micron to 50 microns;

wherein the first layer includes a first plurality of micro-ridges disposed along the first surface and the second layer includes a second plurality of micro-ridges disposed along the second surface;

wherein the first plurality of micro-ridges and the second plurality of micro-ridges contact one another to generate friction between the first layer and the second layer and limit movement of the first layer and the second layer with respect to one another as the composite textile extends along the longitudinal axis in response to a tensile force; and wherein the plurality of hooks attach to the second surface along the longitudinal axis to limit movement of one of the first layer and the second layer with respect to another of the first layer and the second layer along the longitudinal axis in response to the tensile force.

* * * * *